US008624788B2

(12) United States Patent
Ayatollahi

(10) Patent No.: US 8,624,788 B2
(45) Date of Patent: Jan. 7, 2014

(54) ANTENNA ASSEMBLY UTILIZING METAL-DIELECTRIC RESONANT STRUCTURES FOR SPECIFIC ABSORPTION RATE COMPLIANCE

(75) Inventor: Mina Ayatollahi, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 348 days.

(21) Appl. No.: 13/095,456

(22) Filed: Apr. 27, 2011

(65) Prior Publication Data

US 2012/0274523 A1 Nov. 1, 2012

(51) Int. Cl.
*H01Q 9/00* (2006.01)

(52) U.S. Cl.
USPC ..... 343/745

(58) Field of Classification Search
USPC ..... 343/745, 702, 734, 836, 837
See application file for complete search history.

(56) References Cited

U.S. PATENT DOCUMENTS

| | | | | |
|---|---|---|---|---|
| 6,421,016 | B1 * | 7/2002 | Phillips et al. | 343/702 |
| 6,559,803 | B2 * | 5/2003 | Shinichi | 343/702 |
| 6,662,021 | B2 * | 12/2003 | Kang et al. | 455/553.1 |
| 6,708,041 | B1 | 3/2004 | Butovitsch et al. | |
| 6,798,168 | B1 * | 9/2004 | Annamalai et al. | 320/112 |
| 7,042,419 | B2 | 5/2006 | Werner et al. | |
| 7,215,301 | B2 | 5/2007 | Choi et al. | |
| 7,352,328 | B2 | 4/2008 | Moon et al. | |
| 7,570,169 | B2 * | 8/2009 | Li et al. | 340/572.7 |
| 7,586,444 | B2 | 9/2009 | Berlin et al. | |
| 7,760,140 | B2 | 7/2010 | Kamgaing | |
| 7,764,149 | B2 | 7/2010 | Han et al. | |
| 7,773,033 | B2 | 8/2010 | Morton et al. | |
| 8,284,114 | B2 * | 10/2012 | Lin et al. | 343/834 |
| 2002/0167930 | A1 | 11/2002 | Pearl | |
| 2003/0232630 | A1 | 12/2003 | Wilhelm | |
| 2004/0046701 | A1 * | 3/2004 | Huber et al. | 343/702 |
| 2006/0125713 | A1 * | 6/2006 | Thevenot et al. | 343/909 |
| 2009/0028261 | A1 | 1/2009 | Zhang et al. | |

FOREIGN PATENT DOCUMENTS

| | | | |
|---|---|---|---|
| EP | 0843421 | A2 | 5/1998 |
| EP | 1229664 | A1 | 8/2002 |
| EP | 1298809 | A2 | 4/2003 |
| GB | 2360132 | A | 9/2001 |
| WO | WO03013020 | A1 | 2/2003 |

OTHER PUBLICATIONS

Liang; Microstrip Patch Antennas on Tunable Electromagnetic Band-gap Substrates; IEEE Transactions on Antennas and Propagation; vol. 57; No. 6; Jun. 2009; pp. 1612-1617.

(Continued)

*Primary Examiner* — Seung Lee
(74) *Attorney, Agent, or Firm* — Quarles & Brady LLP

(57) ABSTRACT

An wireless communication device has a housing with an exterior surface that is designed to face a user when the wireless communication device is transmitting a radio frequency signal. The communication device includes an antenna disposed inside the housing for emitting a radio frequency signal. A metal-dielectric structure resonates to reflect the radio frequency signal. The metal-dielectric structure is located between the antenna and the exterior surface at a position wherein he metal-dielectric structure traps and reflects the radio frequency signal thereby reducing a specific absorption rate of the wireless communication device.

24 Claims, 3 Drawing Sheets

(56) References Cited

OTHER PUBLICATIONS

Bait-Suwailam, et al.; Mutual Coupling Reduction Between Microstrip Patch Antennas Using Slotted-Complementary Split-Ring Resonators; IEEE Antennas and Wireless Propagation Letters; vol. 8; Jan. 1, 2010; pp. 876-878.
Lihao, et al.; Reduction of mutual coupling between closely-packed antenna elements with split ring resonator (SSR); 2010 International Conference on Microwave and Millimeter Wave Technology; May 8, 2010; pp. 1873-1875.
Gil; Varactor-loaded split ring resonators for tunable notch filters at microwave frequencies; Electronics Letters; vol. 40; No. 21; Oct. 14, 2004; pp. 1347-1348.
Ucar, et al.; Switchable Split-Ring Frequency Selective Surfaces; Progress in Electromagnetics Research B; vol. 6; 2008; pp. 65-79.
Sun, et al, "Electromagnetic Bandgap Enhancement Using the High-Impedance Property of Offset Finite-Ground Microstrip Line," Microwave and Optical Technology Letters, Vo. 47, No. 6, pp. 543-546, Dec. 20, 2005.
Chou, et al, "Investigations of Isolation Improvement Techniques for Multiple Input Multiple Output (MIMO) WLAN Portable Terminal Applications," Progress in Electromagnetics Research, PIER 85, pp. 349-366, 2008.
B. Sanz-Izquierdo, et al., Dual-Band Tunable Screen Using Complementary Split Ring Resonators, IEEE Transactions on Antennas and Propagation, Nov. 2010, vol. 58, No. 11, pp. 3761-3765.
S. S. Karthikeyan, et al., Reduction of specific absorption rate in human tissues using split ring resonators, Indian Institute of Technology Guwahat, Assam, India, IEEE 2009.
Jiunn-Nan Hwang, et al., Reduction of the Peak Sar in the Human Head With Metamaterials, IEEE Transactions on Antennas and Propagation, Dec. 2006, vol. 54, No. 12, pp. 3763-3770.
Sang Il Kwak, et al., Design of Multilayer PIFA based on an EBG structure for SAR reduction in mobile Applications, IEEE 2009, pp. 645-648.
W. Gregorwich, The Design and Development of Frequency Selective Surfaces for Phased Arrays, Lockheed Martin Advanced Technology Center, California, USA, IEEE 1999, pp. 471-479.

* cited by examiner

ANTENNA ASSEMBLY UTILIZING METAL-DIELECTRIC RESONANT STRUCTURES FOR SPECIFIC ABSORPTION RATE COMPLIANCE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE DISCLOSURE

The present disclosure relates to mobile, wireless communication devices, examples of which include handheld, devices such as cellular telephones, personal digital assistants, wirelessly enabled notebook computers, and the like; and more particularly to controlling the emission of the radio frequency signals transmitted by such wireless communication devices to achieve compliance with governmental regulations regarding a specific absorption rate limit.

A wide variety of types of mobile, wireless communication devices are on the market for communicating voice, data, images, and other forms of information. The demand for smaller and thinner devices, present numerous challenges for the antenna design. The antennas must be designed to fit in a limited available space and support various operating characteristics. Because of the close proximity of the phone to the user, compliance with specific absorption rate (SAR) requirements can be a challenge. In FIG. 1 a wireless device 10 with an antenna 12 is shown as being used by a user 14. The antenna can be located internal or external to the device 10. When the device is held against the ear of the user 14, some of the transmitted radio frequency energy emitted from the antenna 12 is absorbed by the user's body, most notably the head 16. A measure of absorption of energy at a particular radio frequency per unit mass of tissue is specified as the Specific Absorption Rate (SAR). As will be appreciated, the SAR value depends heavily upon the location of the transmitting antennas with respect to the body and the intensity and the duration of the transmitted energy.

Government agencies, such as the Federal Communications Commission (FCC) in the United States of America, have adopted limits for safe exposure to radio frequency (RF) energy. For example, the FCC limit for exposure from cellular telephones is a SAR level of 1.6 watts per kilogram (1.6 W/kg), which is referred to as a specific absorption rate limit.

Voice and data transmissions may employ a communication protocol in which the transmissions occur in one millisecond transmission slots contained within a 20 millisecond frame. When transmitting data, it is desirable to utilize as many of transmission slots in each frame as possible in order to send the data quickly. However, the more of the frame that is used, the greater the RF energy that is emitted and thus the specified SAR limit may be exceeded by the data transmission.

As a consequence, in order to comply with the SAR limit, prior communication devices often transmitted with less than an optimal number of transmission slots in each frame and less that the desired signal intensity.

DETAILED DESCRIPTION OF THE DISCLOSURE

Figure 1:
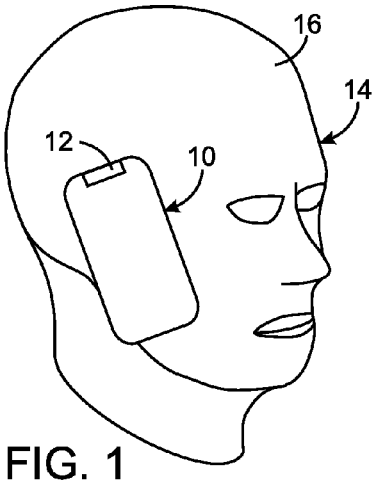
FIG. 1 depicts the head of a person using a wireless communication device, such as a cellular telephone.

The disclosure generally relates to a mobile, wireless communication device, examples of which include mobile or handheld devices, such as pagers, cellular telephones, cellular smart-phones, wireless organizers, personal digital assistants, wirelessly enabled notebook computers, and the like.

A wireless communication device includes an antenna for transmitting a radio frequency (RF) signal. Associated with the antenna are one or more elements that reflect radio frequency energy that is directed towards the user of the communication device. This enables a greater signal intensity and a greater data transmission rate to be used to transmit the RF signal, than otherwise would be possible without the transmission exceeding the specific absorption rate limit.

Each such element comprises a metal-dielectric structure that resonates at a frequency corresponding to the frequency of the signal being transmitted by the wireless communication device. These metal-dielectric structures are placed at locations in the wireless communication device that either the current distribution exceeds a predefined threshold or the electromagnetic field intensity is above a threshold. By way of an example. that threshold may be 70% of the maximum level of the electromagnetic field intensity from the associated antenna. For example, the metal-dielectric structures may be located on a printed circuit board on which the antennas are mounted or they may be located on a surface of the housing that encloses the components of the wireless communication device. Each metal-dielectric structure traps and reflects the surface waves and prohibits its transmission to the user thereby reducing the specific absorption rate of the wireless communication device.

Examples of specific implementations of the present SAR control technique now will be provided. For simplicity and clarity of illustration, reference numerals may be repeated among the figures to indicate corresponding or analogous elements. In addition, numerous specific details are set forth in order to provide a thorough understanding of the embodiments described herein. The embodiments described herein may be practiced without these specific details. In other instances, well-known methods, procedures and components have not been described in detail so as not to obscure the embodiments described herein. Also, the description is not to be considered as limited to the scope of the embodiments described herein.

Figure 3:
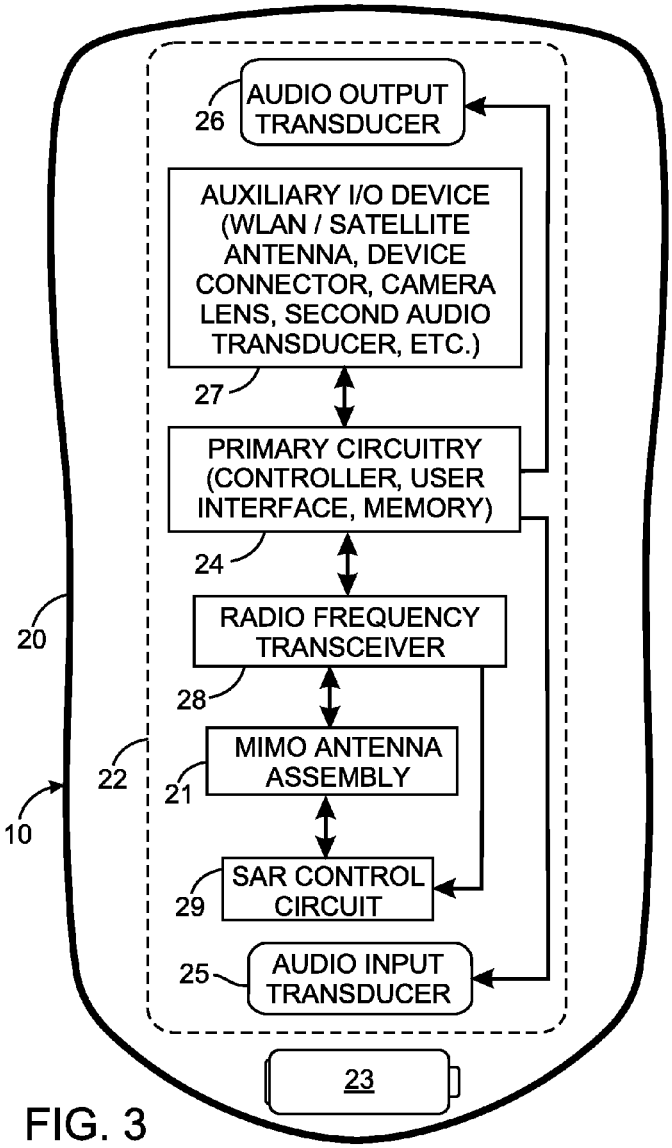
FIG. 3 is a block schematic diagram of the circuitry for an exemplary wireless communication device that utilizes the present technique for limiting the specific absorption rate.

Referring initially to FIG. 3, a mobile, wireless communication device 10, such as a cellular telephone, illustratively includes a housing 20 that may be a static housing or a flip or sliding housing as used in many cellular telephones. Nevertheless, other housing configurations also may be used. A battery 23 is carried within the housing 20 for supplying power to the other internal components.

The housing 20 contains a main printed circuit board (PCB) 22 on which the primary circuitry 24 for the wireless communication device 10 is mounted. That primary circuitry 24, typically includes a microprocessor, one or more memory devices, along with a display and a keyboard that provide a user interface for controlling the device.

An audio input transducer 25, such as a microphone, and an audio output transducer 26, such as a speaker, function as an audio interface to the user and are connected to the primary circuitry 24. The audio input and output transducers 25 and 26 typically are located on one side of the housing 20, which is held against the head of a person who is using the wireless communication device 10.

Communication functions are performed through a radio frequency transceiver 28 which includes a wireless signal receiver and a wireless signal transmitter that are connected to a MIMO antenna assembly 21. The antenna assembly 21 may be carried within the upper portion of the housing 20 and will be described in greater detail herein.

The mobile, wireless communication device 10 also may include one or more auxiliary input/output (I/O) devices 27, such as for example, a WLAN (e.g., Bluetooth®, IEEE. 802.11) antenna and circuits for WLAN communication capabilities, and/or a satellite positioning system (e.g., GPS, Galileo, etc.) receiver and antenna to provide position locating capabilities, as will be appreciated by those skilled in the art. Other examples of auxiliary I/O devices 27 include a second audio output transducer (e.g., a speaker for speakerphone operation), and a camera lens for providing digital camera capabilities, an electrical device connector (e.g., USB, headphone, secure digital (SD) or memory card, etc.).

Figure 4:
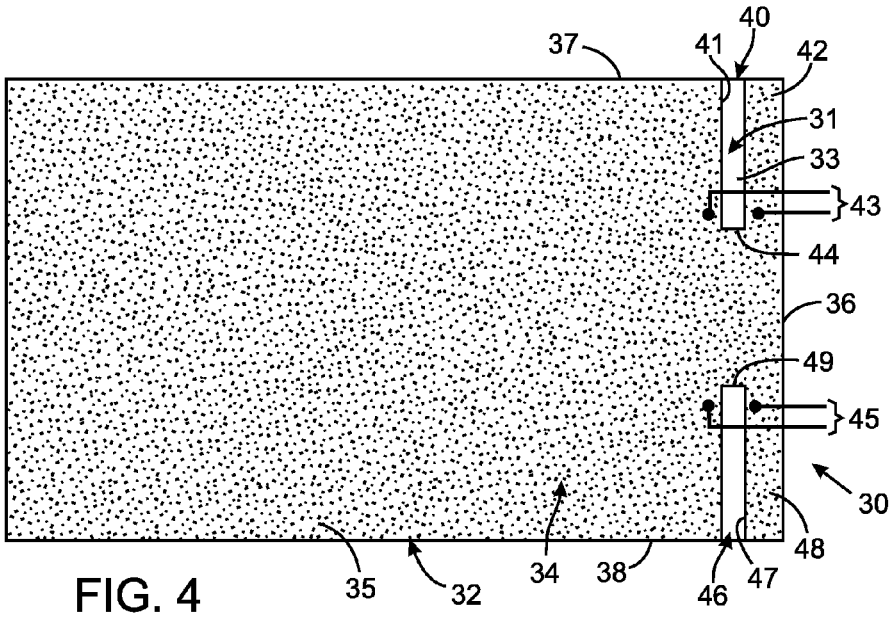
FIG. 4 shows one side of a printed circuit board on which a multiple antenna assembly is formed.

FIG. 4 illustrates an exemplary a first antenna assembly 30 that can be used as the MIMO antenna assembly 21. The first antenna assembly 30 is formed on a printed circuit board 32 that has a non-conductive substrate 31 of a dielectric material with a first major first surface 33 on which a conductive layer 34 is applied to form a ground plane 35. The first surface 33 of the substrate has a first edge 36 and has second and third edges 37 and 38 that are orthogonal to the first edge. The printed circuit board 32 can be part of a printed circuit board on which the radio frequency circuit 28 and/or a controller circuit 29 are mounted or it can be a separate printed circuit board connected to the RF circuitry 28. A first antenna 40 comprises a radiating element formed by an open-ended first slot 41 that extends entirely through the thickness of the conductive layer 34. The first slot 41 extends inwardly from the second edge 37 parallel to and spaced at some distance from the first edge 36. The first slot terminates at a closed end 44. A second antenna 46 is similarly formed by an open-ended second slot 47 extending inwardly from the third edge 38 parallel to and spaced from the first edge 36. The second slot 47 terminates at a closed end 49. In this embodiment, the slots of the two antennas 40 and 46 project inwardly from opposing edges 37 and 38 of the ground plane 35 and longitudinally parallel to the common first edge 36 of the ground plane and thus are aligned with each other. The first and second antennas 40 and 46 oppose each other across a width of the ground plane 35 and may have substantially identical shapes.

The ground plane 35 extends along three sides of the first and second slots 41 and 47. A first conducting strip 42 and a second conducting strip 48 are formed between the printed circuit board's first edge 36 and the open-ended slots 41 and 47, respectively. The width of the conducting strips 42 and 48 can be adjusted to optimize antenna resonant frequency and bandwidth. As a result of this configuration, the first and second slots 41 and 47 form the radiating elements of the first and second antennas 40 and 46, respectively, and are spaced apart by at least one-tenth of a wavelength of the resonant frequency of the second antenna.

A first signal port 43 is provided on opposite sides of the first slot antenna 40 near the closed end 44 for applying a first signal source. A second signal port 45 is provided on opposite sides of the second slot 47 near its closed end 49 for applying a second signal source. These signal ports 43 and 45 are connected to the radio frequency circuit 28 of the wireless communication device 10.

Although the present SAR control apparatus is being described in the context of a communication device with a pair of slot type antennas, that apparatus can be used with a device that has a single antenna or more than two antennas. Likewise, the SAR control apparatus can be used with other types of antennas, such as an inverted F antenna or a microstrip patch antenna, for example.

Figure 2:
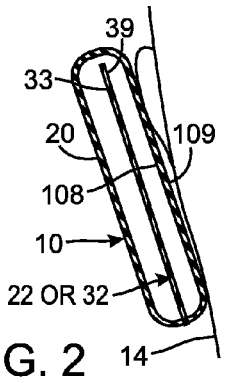
FIG. 2 is a cross section view through the wireless communication device in FIG. 1.
Figure 5:
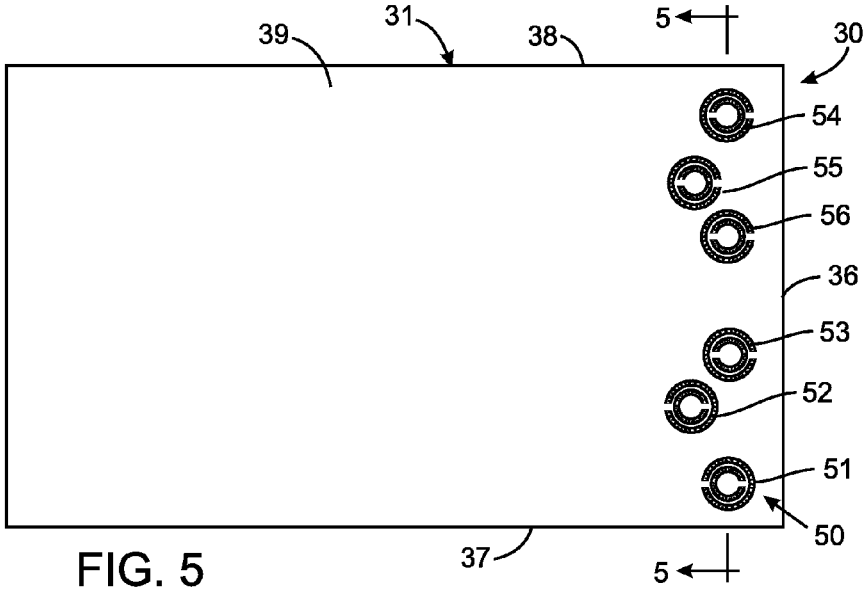
FIG. 5 illustrates the opposite side of the printed circuit board in FIG. 3 on which a SAR control apparatus is mounted.

With reference to FIG. 5, a SAR control apparatus 50 is located on a second major surface 39 on the opposite side of the substrate 31 from the first surface 33 on which the antennas 40 and 46 are located. The second major surface 39 faces the head of the user when the wireless communication device 10 is placed against the user's ear, as shown in FIGS. 1 and 2. The SAR control apparatus 50 comprises one or more metal-dielectric structures associated with each of the first and second antennas 40 and 46. As shown, a first set of three metal-dielectric structures 51, 52 and 53 are located on the second surface 39 of the substrate 31 generally underneath the first antenna 40. At least one of these metal-dielectric structures 51-53 is located at a position where the intensity of the radio frequency signal emitted by the first antenna 40 exceeds a given threshold level. It is through these locations that a relatively intense RF signal would otherwise pass into the head of the user, as shown in FIG. 2, and thus significantly contribute to the specific absorption rate of the wireless communication device 10. For example, the RF signal intensity at these locations as determined from the emission pattern of the first antenna 40. Note that locating the metal-dielectric structures 51-53 based on this criterion does not necessarily form a periodic array, i.e., the spacing between adjacent pairs of the metal-dielectric structures is not identical.

A similar set of metal-dielectric structures 54, 55 and 56 is located on the second surface 39 of the substrate 31 generally underneath the second antenna 46. Each of these additional metal-dielectric structures 54-56 is located at a position in which the intensity of the radio frequency signal emitted by the second antenna 46 exceeds the given threshold level. It should be understood that the number and location of these metal-dielectric isolation structures 51-56 in the drawings is for illustrative purposes and may not denote the actual number and locations for a given antenna assembly design.

The first and second antennas 40 and 46 are designed on the printed circuit board 32 first and their emission patterns determined for the desired radio frequency signals. Based on those emission patterns the paths through the substrate 31 at which the RF signal intensity exceeds the threshold level are found.

A metal-dielectric structure is then placed in each of those places of high signal intensity.

As used herein, a metal-dielectric structure is a tuned resonant cell which has a stop band that reduces propagation of radio frequency signals by trapping and reflecting signals in a defined range of frequencies. Such a structure may comprise an electromagnetic band gap device, a frequency selective surface, or a metamaterial embedded in the printed circuit board substrate 31.

Figure 7:
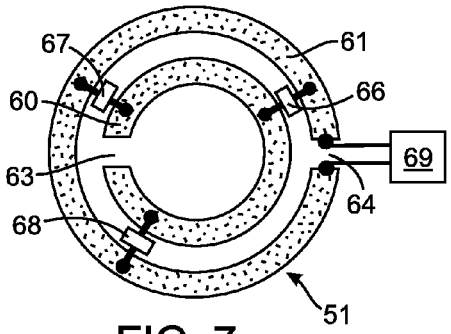
FIGS. 7, 8 and 9 illustrate three different embodiments of a metal-dielectric structure that is included in the SAR control apparatus.

With additional reference to FIG. 7, each of the exemplary metal-dielectric structures 51-56 comprises an electromagnetic band gap device that has two concentric rings 60 and 61 formed a metal pattern adhered to the second surface 39 of the substrate 31. Each metal ring 60 and 61 is not a continuous loop, but has a gap 63 and 64, respectively. The gap 63 in the inner ring 60 is oriented 180° from the gap 64 of the outer ring 61. In other words, the gap is on a side of one ring that is opposite to a side of the other ring on the other gap is located. Each metal-dielectric structure reflects the transmitted signal away from the user, thereby reducing the specific absorption rate of the wireless communication device. That reflection also intensifies the signal transmitted in directions away from the user.

Referring still to FIGS. 4, 5 and 7, each of these metal-dielectric structures 51-56 can be modeled as an inductor-capacitor network forming a tuned circuit that thereby creates a frequency selective surface adjacent the antennas 40 and 46 to reduce the signal transmitted through the printed circuit board 32. Those metal-dielectric structures are designed to have a specific frequency stop band that impedes transmission of the RF signals toward the user of the wireless communication device 10. If each antenna 40 and 46 transmits only at a single frequency, then the metal-dielectric structures 51-56 have a fixed stop band set to impede that frequency emitted from each antenna.

If, however, the operating frequencies of the first and second antennas 40 and 46 are changed with time, the resonant frequency of each metal-dielectric structure 51-56 is tunable to reflect the transmission frequency currently in use. One way of accomplishing that dynamic tuning is to place one or more shorting device, such as switches 66, 67 and 68, at selected locations between the two rings 60 and 61. Each switch 66-68 may be a microelectromechanical system (MEMS), for example, that is controlled by a signal from the SAR control circuit 29. When closed, the respective switch 66, 67 or 68 provides an electrical path that alters the effective electrical length of the rings 60 and 61 and thus the resonant frequency of the metal-dielectric structure. A tuning circuit 69 can be connected across the gap of one or both of the two rings 60 and 61, instead of using the switches 66-68 or the switches and the tuning circuit 69 can be both used together.

Figure 8:
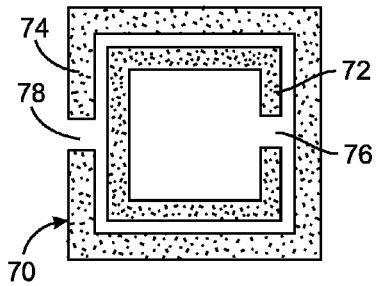

FIG. 8 shows an alternative electromagnetic band gap device type of metal-dielectric structure 70 that has inner and outer rectilinear, e.g. square, rings 74 and 72 formed by contiguous strips of metal. Each rectilinear ring 72 and 74 has a gap 76 and 78, respectively, with the gap on one ring being on the diametrically opposite side from the gap on the other ring. A set of switches, like switches 66-68, can be connected between the inner and outer square rings to dynamically tune the alternative metal-dielectric structure 70 to resonate at different radio frequencies.

Figure 9:
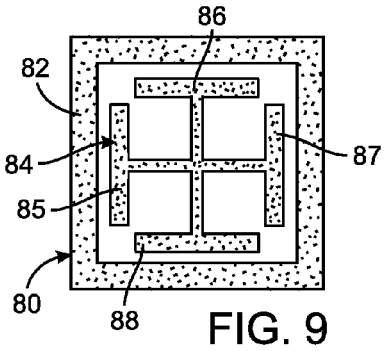

FIG. 9 depicts another electromagnetic band gap device type of metal-dielectric structure 80 that can be used as a resonant SAR cell. This structure 80 has a square ring 82 that is continuous and does not have a gap. Within the square ring 82 is an interior element 84 having a shape of a Jerusalem cross. Specifically the interior element 84 has four T-shaped members 85, 86, 87 and 88, each having a cross section extending parallel to and spaced from one side of the square ring 82. Each T-shaped member 85-88 has a tie section that extends from the respective cross section to the center of the square ring 82 at which point all the T-shaped members are electrically connected. Switches can be connected at various locations between the T-shaped members 85-88 and the square ring 82 to dynamically tune the resonate frequency of the metal-dielectric structure 80.

Figure 6:
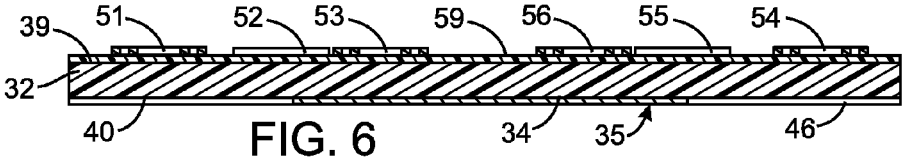
FIG. 6 is a cross sectional view through printed circuit board along line 5-5 in FIG. 5.

FIG. 6 depicts another technique for dynamically tuning a metal-dielectric structure. In this instance, a layer 59 of a liquid crystal polymer is deposited upon the second surface 39 of the substrate 31 which surface 39 is on the opposite side of the printed circuit board 32 from the first and second antennas 40 and 46. The metal-dielectric structures 51-56 are formed on the outer surface of the liquid crystal polymer layer 59 in locations with respect to the two antennas as previously described.

A liquid crystal polymer has a dielectric characteristic that changes in response to variation of a DC voltage applied thereto. Therefore, when the radio frequency transceiver 28 alters the tuning of the first and second antennas 40 and 46, a signal is sent to the SAR control circuit 29 which applies a DC voltage that biases the liquid crystal polymer layer 59 with respect to the ground plane 35. That biasing alters the dielectric characteristic of the metal-dielectric structures 51-56, thereby changing their resonant frequencies to correspond to the radio frequencies that excite the antennas. A common liquid crystal polymer layer 59 is employed in the illustrated embodiment to change the resonant frequency of all the metal-dielectric structures 51-56 in unison. Alternatively, separate liquid crystal polymer layers can be defined under each set of metal-dielectric structures associated with each of the first and second antennas 40 and 46 to separately tune each set of structures to the specific frequency of the associated antenna. As a further variation, separate liquid crystal polymer layers can be defined under each metal-dielectric structure 51-56, thereby enabling the resonant frequency of each structure to be tuned independently.

Figure 10:
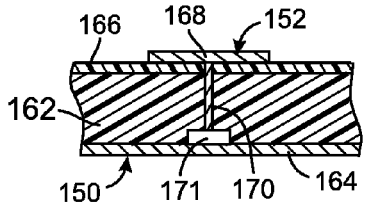
FIG. 10 is a cross sectional view through printed circuit board on which a tunable mushroom type metal-dielectric structure is formed.

FIG. 10 illustrates another arrangement for dynamically tuning a metal-dielectric structure 150. A printed circuit board 160 comprises a substrate 162 of dielectric material with a first major surface that has a layer 164 of electrically conductive material thereon. That electrically conductive layer 164 forms a ground plane. A liquid crystal polymer layer 166 covers the opposite surface of the substrate 162.

A metal-dielectric structure 152 is formed on the opposite substrate surface and may be a "mushroom" type electromagnetic band gap device. That type of device comprises a patch style metal pattern 168 formed on the liquid crystal polymer layer 166. The metal pattern 168 is connected to the electrically conductive layer 164 by a via 170. The metal-dielectric structure 152 is dynamically tuned to correspond to the frequencies of the signals emitted by an adjacent antenna (not shown). That dynamic tuning is accomplished by the SAR control circuit 29 varying a DC voltage applied between the liquid crystal polymer layer 166 and the electrically conductive layer 164. In addition or in the alternative, the via 170 may be connected to the electrically conductive layer 164 by a switch 171, such as a MEMS, for example.

It should be appreciated that more than one such metal-dielectric structure 152 can be employed in a particular antenna assembly, depending upon the locations at which the radio frequency signal needs to be suppressed for SAR compliance.

Figure 11:
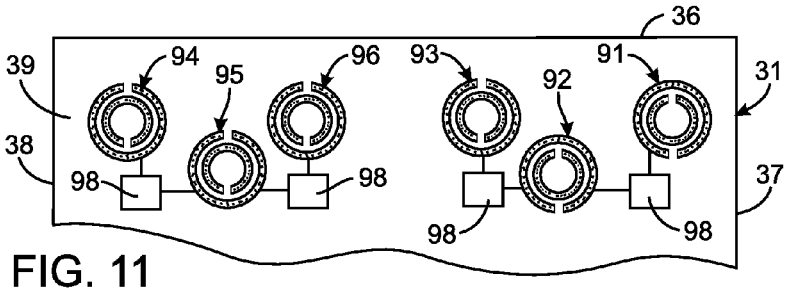
FIG. 11 illustrates yet another mechanism for dynamically tuning the metal-dielectric structures.

FIG. 11 illustrates an alternative technique for varying the resonant frequency of the metal-dielectric structures. The antenna assembly the same as shown in FIG. 4 and six metal-dielectric structures 91-96 are located on the second surface 39 of the printed circuit board 32 at locations where the intensity of the radio frequency signal emitted by the first and second antennas 40 and 46 exceeds the given threshold level. This places the metal-dielectric structures 91-96 between the antennas and the user's head when the wireless communication device 10 is being used as shown in FIG. 2. Specifically the metal-dielectric structures 91-96 are placed between the antennas and the exterior surface 109 of the surface of the wireless communication device 10 which faces the user 14. Note that the six metal-dielectric structures 91-96 are not necessarily located in a periodic array, i.e., the spacing between adjacent pairs of the metal-dielectric structures is not identical.

For dynamic tuning purposes, an inductive-capacitive (LC) lumped element network 98 is connected between adjacent pairs of the metal-dielectric structures 91-96. The LC lumped element network 98 has an inductor and a capacitor that is variable in response to a signal from the SAR control circuit 29 within the wireless communication device 10. By varying the inductance or capacitance of the lumped element networks 98, the resonant frequency of the metal-dielectric structures 91-96 is varied to correspond to the dynamic tuning of the two antennas 40 and 46 to different excitation frequencies.

Figure 12:
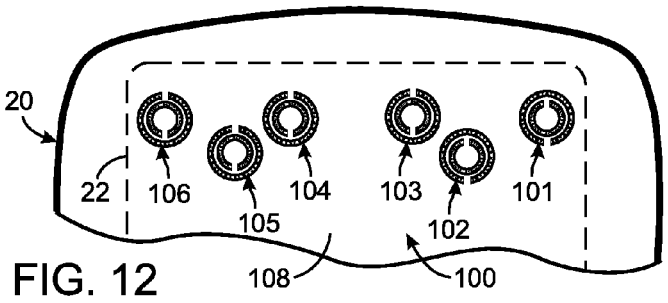
FIG. 12 shows a SAR control apparatus mounted on the housing of the wireless communication device.

Although the embodiments of the SAR control apparatus described thus far have located the metal-dielectric structures on the printed circuit board, those structures can be mounted on other components of the wireless communication device. In FIG. 12 for example, the SAR control apparatus 100 comprises metal-dielectric structures 101-106 mounted on the inside surface 108 of the housing 20 of the wireless communication device 10. The metal-dielectric structures 101-106 are located on a portion of the housing 108 that is between the antennas and the user when the wireless communication device is held against the user's head during use (see FIGS. 1 and 2). As with the previous embodiments, the metal-dielectric structures 101-106 are located places where the intensity of the transmitted signal exceeds a predefined threshold. Each metal-dielectric structure 101-106 reflects the transmitted signal away from the user, thereby reducing the specific absorption rate of the wireless communication device. It should be understood that the number and location of these metal-dielectric structures 101-106 is for illustrative purposes and may not reflect the actual number and locations for a given antenna assembly design. Additional, metal-dielectric structures may be located adjacent to positions where the user places fingers to hold the wireless communication device.

The foregoing description was primarily directed to a preferred embodiment of the disclosure. Although some attention was given to various alternatives within the scope of the disclosure, it is anticipated that one skilled in the art will likely realize additional alternatives that are now apparent from of the embodiments described herein. Accordingly, the scope of the protection provided hereby should be determined from the following claims and not limited by the above disclosure.

The invention claimed is:

1. A wireless communication device having a housing with an exterior surface which is designed to face a user when the wireless communication device is transmitting a radio frequency signal, said wireless communication device comprising:

an antenna disposed inside the housing for emitting a radio frequency signal; and a metal-dielectric structure that resonates to reflect the radio frequency signal and that is located between the antenna and the exterior surface at a position wherein the metal-dielectric structure reduces a specific absorption rate of the wireless communication device.

2. The wireless communication device as recited in claim 1 wherein the metal-dielectric structure is located at a position at which the radio frequency signal has an intensity in excess of a predefined threshold level.

3. The wireless communication device as recited in claim 1 further comprising:

a substrate of dielectric material and having a first surface and a second surface on opposite sides of the substrate, wherein the antenna is disposed on the substrate; and a ground plane formed by a layer of electrically conductive material on the first surface.

4. The wireless communication device as recited in claim 3 wherein the metal-dielectric structure is supported by the substrate.

5. The wireless communication device as recited in claim 3 wherein the metal-dielectric structure comprises a metal pattern on the second surface of the substrate.

6. The wireless communication device as recited in claim 1 wherein the metal-dielectric structure is on a surface of the housing.

7. The wireless communication device as recited in claim 1 wherein the metal-dielectric structure comprises a rectilinear ring within which is an element shaped as a Jerusalem cross.

8. The wireless communication device as recited in claim 1 wherein the metal-dielectric structure comprises a pair of concentric rings each having a gap.

9. The wireless communication device as recited in claim 8 wherein the gap is on a side of one ring that is opposite to a side of the other ring on the other gap is located.

10. The wireless communication device as recited in claim 8 wherein the pair of concentric rings are either circular or rectilinear.

11. The wireless communication device as recited in claim 8 further comprising a switch for selectively creating an electrical path between the pair of concentric rings that alters a resonant frequency of the metal-dielectric structure.

12. The wireless communication device as recited in claim 1 wherein the metal-dielectric structure resonates at a given frequency; and further comprising a device for varying the given frequency.

13. The wireless communication device as recited in claim 12 wherein the device comprises a layer of liquid crystal polymer on which the metal-dielectric structure is mounted; and a circuit for applying a variable voltage to the layer.

14. The wireless communication device as recited in claim 1 wherein the metal-dielectric structure is isolated from electrical ground of the wireless communication device.

15. A wireless communication device having a housing with an exterior surface which is designed to face a user when the wireless communication device is transmitting a radio frequency signal, said wireless communication device comprising:

a substrate of dielectric material and having a first surface and a second surface on opposite sides of the substrate;

a ground plane formed by a layer of electrically conductive material on the first surface;

a first antenna disposed on the substrate;

a second antenna disposed on the substrate and spaced apart from the first antenna; and a plurality of metal-dielectric structures located between first and second antennas and the exterior surface of the housing, wherein each metal-dielectric structure resonates at a given frequency to reflect the radio frequency signal and thereby affect a specific absorption rate of the wireless communication device.

16. The wireless communication device as recited in claim 15 wherein plurality of metal-dielectric structures are located in a non-periodic array.

17. The wireless communication device as recited in claim 15 wherein each of the plurality of metal-dielectric structures is at a location where the radio frequency signal has an intensity that exceeds a predefined threshold.

18. The wireless communication device as recited in claim 15 wherein each of the plurality of metal-dielectric structures is on the substrate.

19. The wireless communication device as recited in claim 15 wherein each of the plurality of metal-dielectric structures comprises a pair of either circular or rectilinear concentric rings, each having a gap.

20. The wireless communication device as recited in claim 19 wherein the gap is on a side of one ring that is opposite to a side of the other ring on the other gap is located.

21. The wireless communication device as recited in claim 19 further comprising a switch for selectively creating an electrical path between the pair of concentric rings of one of the plurality of metal-dielectric structures, wherein the electrical path alters a resonant frequency of that one metal-dielectric structure.

22. The wireless communication device as recited in claim 15 wherein each of the plurality of metal-dielectric structures comprises a rectilinear ring within which is an element shaped as a Jerusalem cross.

23. The wireless communication device as recited in claim 15 further comprising a device for dynamically varying the given frequency of each of the plurality of metal-dielectric structures.

24. The wireless communication device as recited in claim 15 further comprising a layer of liquid crystal polymer on the substrate adjacent to the plurality of metal-dielectric structures; and a circuit for applying a variable voltage to the layer which thereby defines the given frequency at which each of the plurality of metal-dielectric structures resonates.

* * * * *